United States Patent [19]

Gerretz et al.

[11] 4,005,595

[45] Feb. 1, 1977

[54] FEEDING WORKPIECE APPARATUS FOR COLD PILGER ROLLING MILLS

[75] Inventors: Josef Gerretz, Viersen; Klaus Rehag, Rheydt, both of Germany

[73] Assignee: Wean United, Inc., Pittsburgh, Pa.

[22] Filed: Sept. 26, 1975

[21] Appl. No.: 616,978

[52] U.S. Cl. ..... 72/250; 72/208

[51] Int. Cl.[2] ..... B21B 17/06; B21B 39/06

[58] Field of Search ..... 72/250, 252, 208, 193

[56] References Cited

UNITED STATES PATENTS

| | | | |
|---|---|---|---|
| 2,387,515 | 10/1945 | Inslee | 72/252 X |
| 2,388,251 | 11/1945 | Coe | 72/208 |
| 3,411,336 | 11/1968 | Wadleck | 72/209 X |
| 3,670,549 | 6/1972 | Tselikov | 72/214 X |
| 3,862,500 | 1/1975 | Grinshpun et al. | 72/252 |

*Primary Examiner*—Milton S. Mehr
*Attorney, Agent, or Firm*—Daniel Patch

[57] ABSTRACT

The disclosure relates to a workpiece feed apparatus for cold pilger rolling mills having at least one feed spindle for at least one feed carriage, and having a feed transmission which is connected to the main drive and comprises two branches or lines of drive, of which the first line of drive is connected with a gear wheel secured on the feed spindle for producing a continuous rotational movement of the feed spindle, and the second line of drive is connected by way of an intermittently moved lever with the feed spindle for the purpose of producing an intermittent axial movement of the feed spindle.

11 Claims, 5 Drawing Figures

FEEDING WORKPIECE APPARATUS FOR COLD PILGER ROLLING MILLS

Figure 1:
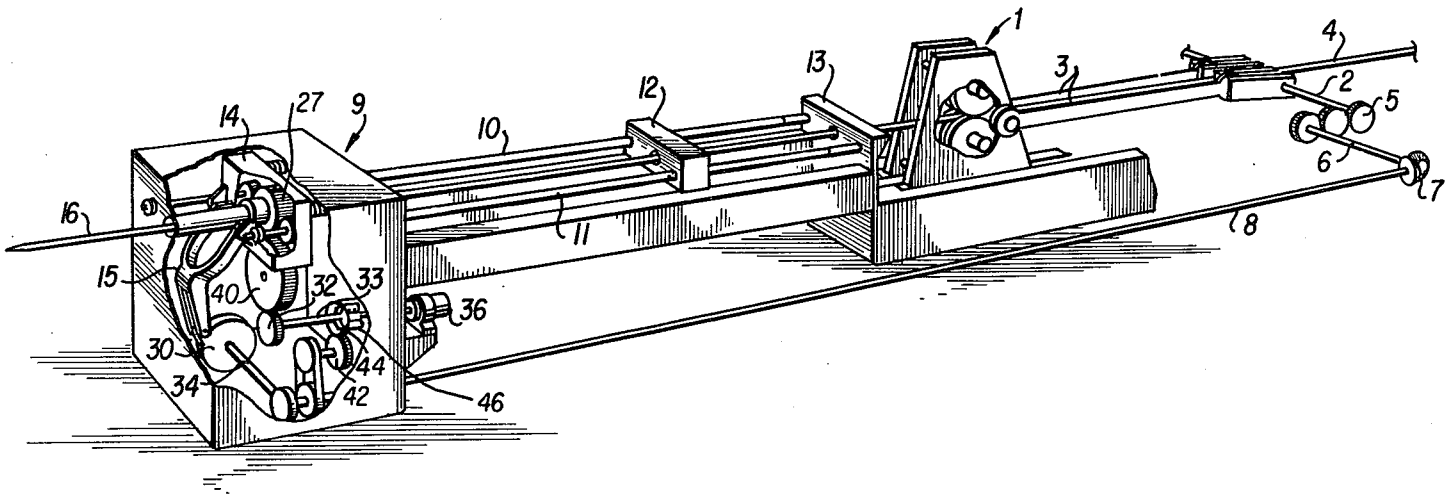

Cold pilger rolling mills are known wherein the feeding of the workpiece is produced by intermittent rotation of a feed spindle. Preferably spindles are arranged one on the right and one on the left of the rolling center. The feed spindles have a heavy-duty axial bearing in the feed transmission, which transmission is also known in technical circles as a control transmission. The spindle nuts are arranged in a feed carriage. The advantage of this arrangement is considered to be that the feed force is introduced directly into the feed carriage without a moment being produced. The feed force or the axial reaction force from the rolling force may be very considerable. Nevertheless, only short guides are required for the feed carriage since, as already mentioned, no tilting moment acts on the feed carriage. But the mechanical outlay for the intermittent rotation of the spindles is very considerable. For this reason feed apparatus which rotate the spindle intermittently, and also non-hydraulic drives, have not become fully accepted for high-speed cold pilger rolling mills, and the susceptibility of the feed apparatus to develop faults in the case of machines running at high speeds has also been an important factor.

Therefore, in high-speed cold pilger rolling mills it has been preferred to use a feed arrangement using a constantly rotating feed spindle which at the same time carries out an intermittent oscillatory movement, and the disadvantage has been accepted that the feed force in the feed carriage produces a tilting moment which is dependent on the feed force itself and on the distance between the feed spindle and the rolling center. This disadvantage resulted in the fact that the length of the guides of the feed carriage had to be a multiple of the width of the guide and that the guide bed of the feed carriage had to be of very robust construction. The length of the guide of the feed carriage, however, is a factor in the length of the rolling mill in regard to investment costs. The feed spindle itself did not have any axial bearing arrangement there since it had to carry out an axial movement. There was only a force-applied connection between the cam disc of a second line of drive, arranged in the feed transmission, a lever and the feed spindle. The force-applied connection was established by a spring, and the lever acts directly on the spindle. Since there was only this force-applied connection between the elements of the feed drive, these cold pilger rolling mills can only be constructed with one spindle.

The invention has as its object to construct the feed apparatus for a cold pilger rolling mill in such a manner that it is possible to obtain greater effectiveness in the production of tubes.

The invention aims at arranging the feed apparatus for a cold pilger rolling mill in such a manner that by constructional modifications an increased output is obtained without considerably increasing the mechanical outlay, and it is to be suitable more particularly for high-speed cold pilger rolling mills.

According to the invention, therefore, it is proposed that at the two sides of the rolling center there are provided two feed spindles which are connected with one another by way of a longitudinally mobile transverse member, the two feed spindles being mounted to be rotatable at least each in an axial bearing and a radial bearing in the transverse member, and a lever of a second line of drive acts on the transverse member.

The invention achieves the result that the feed carriage is free of tilting moments resulting from the feed. At the same time the result is achieved that two rotating oscillatory feed spindles are so connected to one another that their movements are carried out synchronously and the two spindles are uniformly loaded.

According to a further constructional form of the invention, in each case an axial bearing and a radial bearing can be combined to form a combined axial-radial bearing. The transverse member itself is arranged in the feed transmission housing, it is conveniently of box-shaped construction, and is mounted in each case at two points on each feed spindle. Thus, there is no need for a special guiding and supporting arrangement for the transverse member.

The connection to the drive apparatus can be such that the gear wheels of the feed spindles are in mesh with a central wheel driven by the first line of drive of the transmission, that the central wheel is mounted on a hollow shaft mounted in the transverse member, and that the central wheel and the gear wheels are arranged in the box-like cross-member.

For discontinuous cold pilger rolling mills, it is sufficient if the internal diameter of the hollow shaft is larger than the diameter of the mandrel bar; whereas, for continuous cold pilger rolling mills the internal diameter of the hollow shaft is to be larger than the external diameter of a tube billet which is to be rolled out. In both cases the longitudinal axis of the hollow shaft is to be situated on the rolling axis and in the same plane as the longitudinal axes of the feed spindles.

The connection of the lever acting on the transverse member is conveniently made such that the lever is fork-shaped and is connected at the two sides of the hollow shaft in such a manner to the transverse member that the common horizontal axis of the two connecting joints provided at the fork ends intersects the longitudinal axis of the hollow shaft at right angles.

Finally, the present invention provides an arrangement wherein the per se known spring provided for pressing a roller of the two-arm lever on the cam disc of the feed transmission is arranged between the transverse member and a fixed point, preferably the feed transmission housing.

Figure 2:
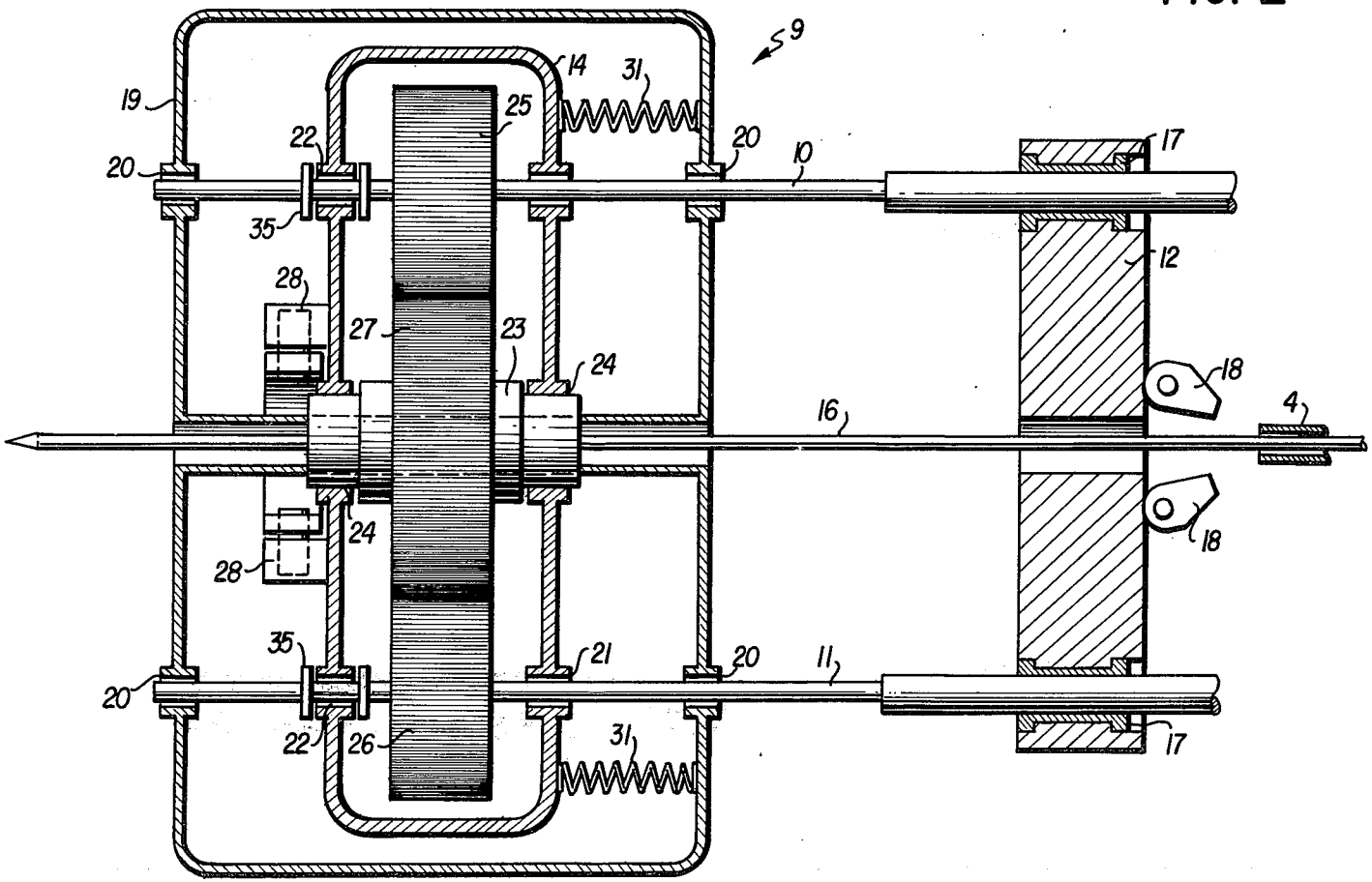
Figure 3:
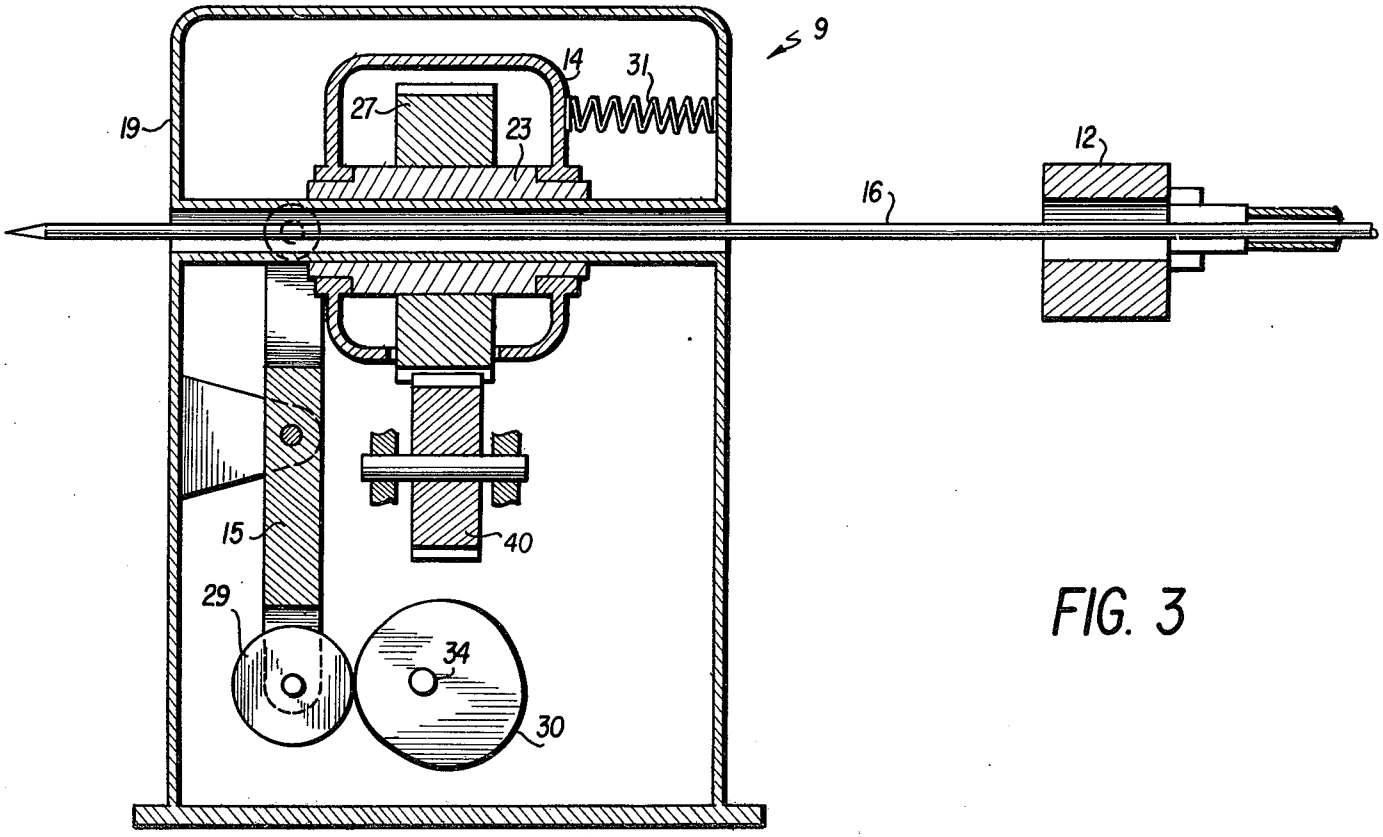
Figure 4:
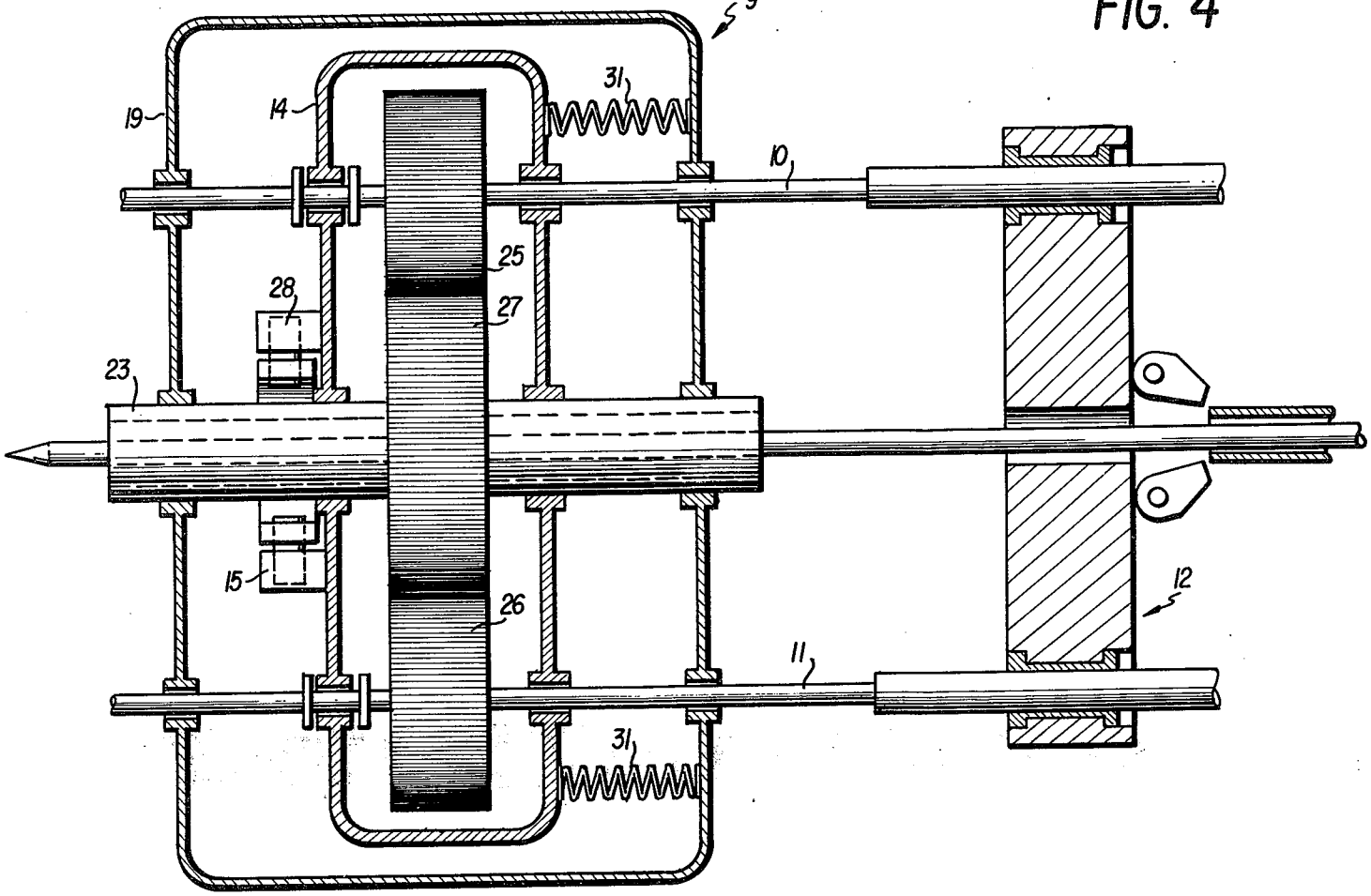
Figure 5:
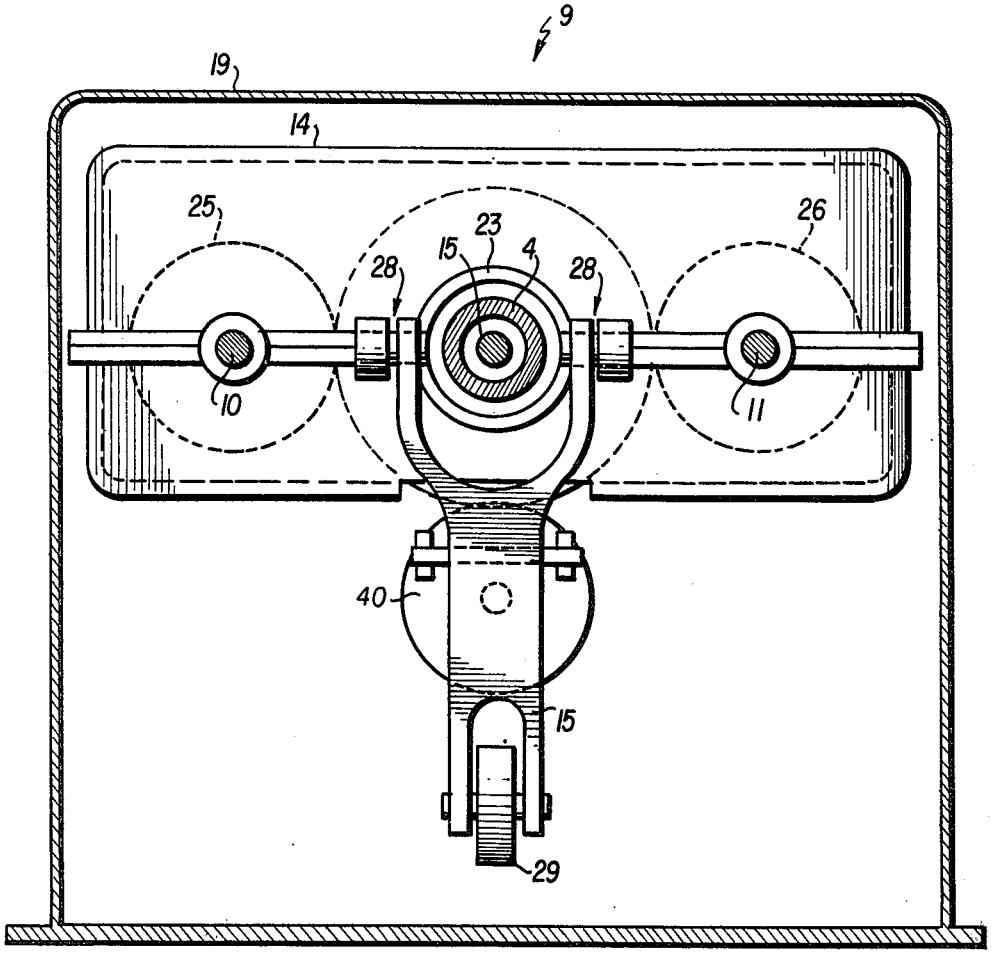

The invention is represented in diagrammatic form with the use of constructional examples in the accompanying drawings wherein:

FIG. 1 shows a cold pilger rolling mill in perspective with the feed apparatus according to the invention, FIG. 2 shows a section through the feed apparatus in the plane defined by the two feed spindles, FIG. 3 shows a further section through the feed transmission, FIG. 4 is a section similar to FIG. 2 showing a feed transmission, but wherein the hollow shaft is mounted in the feed transmission housing, and FIG. 5 shows a rear view of the transverse member shown in the previous figures.

The cold pilger rolling mill shown in perspective in FIG. 1 comprises a stand 1 which is capable of moving to and fro in which grooved rolls are arranged and are moved to and fro by means of a pair of crank rods 3 operated by a main driving shaft 2. The reference character 4 designates a tube which has been subjected to a cold pilger process.

From the main driving shaft 2 by means of an intermediate gear 5 a line of drive is taken through a shaft 6, a set of angle gears 7 and a further shaft 8 to drive a feed transmission 9. The feed transmission 9 drives two feed spindles 10 and 11 which allow a feed carriage 12 to be advanced in order to maintain the feed carriage in proper position to intermittently advance the tube when the carriage is displaced by a cam advance means in time relationship with the mill. The feed spindles 10 and 11 are mounted to be axially mobile in the housing of the feed transmission 9 on the one hand and in a cross-piece 13 on the other hand. The feed spindles 10 and 11 are supported axially in a transverse member 14 which is intermittently axially mobile and whose axial movement is produced by means of a lever 15. A mandrel bar 16 projects from the feed transmission 9. The details of the transmission arrangement are explained further with the use of the other illustrations.

FIG. 2 shows further details of the feed carriage 12, namely, spindle nuts 17, and mobile holding jaws 18. The feed transmission 9 which through the jaws 18 engages the adjacent end of the tube 4 and push the tube into the mill comprises a feed transmission housing 19 in which the feed spindles 10 and 11 are mounted to be axially mobile by means of bearings 20. The transverse member 14 itself is mounted on the feed spindles 10 and 11 by means of, in each case, a radial bearing 21 and a combined axial and radial bearing 22. A hollow shaft 23 is mounted to be rotatable by the use of fixed bearings 24 in the transverse member.

On the hollow shaft 23 there is arranged a central wheel 27 which meshes with gear wheels 25, 26 arranged one on each of the feed spindles 10, 11 respectively.

In FIG. 3 the gear wheel 27 is shown meshing with a driven further gear wheel 40 which in turn meshes with a gear 32 of a first line of the drive shaft 33 of the feed transmission; whereas, a cam disc 30 is to be associated with a second line of drive shaft 34 of the feed transmission. The two lines of drive shafts 33 and 34 are shown clearly in the perspective view shown in FIG. 1.

The drive shaft 33 receives its power from a gear 42 in mesh with a gear 44 that forms a part of a clutch 46, the clutch normally imparting the driving power to the shaft 33 from the gear 42 during rolling. The clutch is disengaged during the return of the carriage 12 to its initial position to receive the new tube to be rolled, during which time the high speed motor 36 only drives the shaft 33 in a reverse direction to rotate the spindles so that the feed carriage 12 is moved to the left when one views FIG. 1.

FIGS. 3 and 5 together show that the lever 15 is fork-shaped and connected at the two sides of the hollow shaft 23 in such a manner to the transverse member 14 that the common horizontal axis of the two connecting joints 28 provided at the ends of the fork intersect at right angles the longitudinal axis of the hollow shaft. Spring 31 provided for pressing a roller 29 of the two-arm lever 15 against a cam disc 30 is arranged between the transverse member 14 and the feed transmission housing 19. The axial movement of the member 14 is imparted to the spindles 10 and 11 by two pairs of collars 35. After the completion of the rolling operation, the feed carriage 12 is returned to its starting position by an high-speed return drive unit 36.

FIG. 4 shows a variant as regard the construction and mounting of the hollow shaft 23 which, in this example, also extends through the transmission housing 19.

In operation the feed transmission unit 9 feeds the tube 4 into the mill 1 in a synchronous relationship with the mill's crank motion by the continuous rotation of the feed spindles 10 and 11 produced by the gears 25 and 26 and the timed intermittent axial movement caused by the cam 30 in rotation the feed spindles allow the traverse member 14 to be repositioned and yet maintain the carriage 12 in proper position to advance the tube, so that the feed carriage 12 may be intermittently advanced by the cam 30 in synchronous with the mill until it reaches a position adjacent the mill, after which it will be returned by the high speed motor 36.

In accordance with the provisions of the patent statutes, we have explained the principle and operation of our invention and have illustrated and described what we consider to represent the best embodiment thereof.

We claim:

1. A feeding apparatus for advancing a workpiece to a cold pilger rolling mill,
   feed spindle means,
   a workpiece feed carriage engaged for advance by said feed spindle means,
   feed transmission means,
   drive means,
   means for connecting said feed transmission means to said drive means,
   said feed transmission means having two drive lines for said feed spindle means,
   a first of said drive lines being connected to gear means secured to said feed spindle means for producing a continuous rotational movement of said feed spindle means,
   a second of said drive lines being connected to said feed spindle means by a lever for producing intermittent axial movement of said feed spindle means,
   said feed spindle means comprising two feed spindles arranged on opposite sides of the rolling center of said mill,
   a longitudinal movable transverse member for connecting said two feed spindles to one another,
   axial-radial bearing means for each feed spindle mounted in said feed transmission means, and
   said lever arranged operably with said second drive line for acting on said transverse member.

2. A feeding apparatus according to claim 1 wherein said bearing means comprises an axial bearing combined with a radial bearing to constitute a combined axial-radial bearing.

3. A feeding apparatus according to claim 1 wherein said transverse member is of box-shaped construction and is mounted as to each said feed spindle at two points on each feed spindle.

4. A feeding apparatus according to claim 1 wherein said transverse member is arranged in said feed transmission means.

5. A feeding apparatus according to claim 4 wherein said gear means comprises two gear wheels mounted on a different one of said feed spindles and arranged to mesh with a third gear wheel driven by said first drive line of the feed transmission means,
   said third wheel being mounted on a hollow shaft,
   means for mounting said hollow shaft in said transverse member, and
   said third gear wheel and said other two gear wheels arranged in said transverse member.

6. A feeding apparatus according to claim 5 wherein the internal diameter of said hollow shaft is larger than the diameter of a mandrel bar employed with said mill.

7. A feeding apparatus according to claim 5 wherein the internal diameter of said hollow shaft is larger than the external diameter of a tube billet which is to be rolled.

8. A feeding apparatus according to claim 5 wherein said feed transmission means includes means for supporting said hollow shaft.

9. A feeding apparatus according to claim 5 wherein the longitudinal axis of said hollow shaft is situated on the rolling axis of said mill and in the same plane as the longitudinal axes of said feed spindles.

10. A feeding apparatus according to claim 9 wherein said lever has fork-shaped ends which ends are connected at opposite sides of said hollow shaft to said transverse member in such a manner that the common horizontal axis of the two connecting joints provided at the ends of said lever intersects the longitudinal axis of said hollow shaft at right angles.

11. A feeding apparatus according to claim 1, a cam included in said second drive line, a roller carried by said lever arranged to engage said cam, and spring means arranged to bias said transverse member for urging said roller and cam into contact with each other.

* * * * *